US009227191B2

(12) United States Patent
Belotserkovskiy et al.

(10) Patent No.: US 9,227,191 B2
(45) Date of Patent: Jan. 5, 2016

(54) CONE CRUSHER HAVING AN ARRANGEMENT FOR MEASURING A POSITION OF A CRUSHING SHELL

(71) Applicant: SANDVIK INTELLECTUAL PROPERTY AB, Sandviken (SE)

(72) Inventors: Konstantin Belotserkovskiy, Malmo (SE); Rickard Svensson, Svedala (SE)

(73) Assignee: SANDVIK INTELLECTUAL PROPERTY AB, SANDVIKEN (SE)

( * ) Notice: Subject to any disclaimer, the term of this patent is extended or adjusted under 35 U.S.C. 154(b) by 0 days.

(21) Appl. No.: 14/361,717

(22) PCT Filed: Nov. 13, 2012

(86) PCT No.: PCT/EP2012/072519
§ 371 (c)(1),
(2) Date: May 30, 2014

(87) PCT Pub. No.: WO2013/079319
PCT Pub. Date: Jun. 6, 2013

(65) Prior Publication Data

US 2014/0339347 A1 Nov. 20, 2014

(30) Foreign Application Priority Data

Dec. 1, 2011 (EP) ..... 11191503

(51) Int. Cl.
*B02C 2/04* (2006.01)
*B02C 25/00* (2006.01)
*B02C 2/00* (2006.01)

(52) U.S. Cl.
CPC ..... *B02C 2/047* (2013.01); *B02C 2/042* (2013.01); *B02C 2/045* (2013.01); *B02C 25/00* (2013.01); *B02C 2/00* (2013.01)

(58) Field of Classification Search
CPC ..... B02C 25/00; B02C 2/00; B02C 2/045; B02C 2/047
USPC ..... 241/37, 207, 209, 211
See application file for complete search history.

(56) References Cited

U.S. PATENT DOCUMENTS

| | | | | |
|---|---|---|---|---|
| 4,717,084 | A | 1/1988 | Vendelin | |
| 2007/0051837 | A1 * | 3/2007 | Juhlin | 241/37 |
| 2010/0102152 | A1 * | 4/2010 | Belotserkovsky | 241/30 |

OTHER PUBLICATIONS

Rasner,H. "Induktive positionsmessung-beruhrungslos und robust", Dec. 8, 2008, http://www.technikweblook.com/index.php?module=Pagesetter&func=viewpub&tid=5pid=1986.
"Sensoren und Systeme fur die Fabrikautomation", Oct. 25, 2011, Pepper + Fuchs, XP002675473, p. 1, 6, 718, p. 718, col. 1.

* cited by examiner

*Primary Examiner* — Faye Francis
(74) *Attorney, Agent, or Firm* — Corinne R. Gorski

(57) ABSTRACT

A cone crusher includes an outer crushing shell and an inner crushing shell forming a crushing gap there between. The outer crushing shell is supported on an upper frame member in vertically adjustable engagement with a lower frame member. A sensor arrangement having a sensor element is provided for measuring the vertical position of the outer crushing shell. The cone crusher further includes a target means arranged to be detectable by the sensor element, wherein one of the target means and the sensor element are arranged to follow vertical movement of the upper frame member and to move in relation to the other one of the target means and the sensor element. The sensor element includes a vertical sensing array which extends in a vertical direction along at least a portion of a range within which the target means may be moved upon adjusting the vertical position of the upper frame member.

13 Claims, 4 Drawing Sheets

CONE CRUSHER HAVING AN ARRANGEMENT FOR MEASURING A POSITION OF A CRUSHING SHELL

RELATED APPLICATION DATA

This application is a §371 National Stage Application of PCT International Application No. PCT/EP2012/072519 filed Nov. 13, 2012 claiming priority of EP Application No. 1191503.9, filed Dec. 1, 2011.

TECHNICAL FIELD OF THE INVENTION

The present invention relates to a cone crusher comprising an outer crushing shell and an inner crushing shell forming between them a crushing gap, the outer crushing shell being supported on an upper frame member in vertically adjustable engagement with a lower frame member, said vertically adjustable engagement being configured for adjusting the vertical position of the outer crushing shell relative to the lower frame member so as to permit adjustment of the width of the crushing gap. The cone crusher further comprises a sensor arrangement provided with a sensor element mounted to one of the lower frame member and the upper frame member.

BACKGROUND ART

A cone crusher may be utilized for efficient crushing of material, such as stone, ore etc., into smaller sizes. US 2010/0102152 A1 describes an exemplary cone crusher. In such a cone crusher, material is crushed between an outer crushing shell, which is mounted in a frame, and an inner crushing shell, which is mounted on a crushing head. The material is crushed by making the crushing head gyrate such that it rolls on the outer crushing shell via the material to be crushed.

The crusher of US 2010/0102152 A1 is provided with a proximity sensor for measuring the position of the outer crushing shell. The position of the outer crushing shell should be measured with a high accuracy to enable efficient crusher operation, and a crushed material having the desired properties.

SUMMARY OF THE INVENTION

An object of the present invention is to provide a crusher having an improved level of accuracy as regards the measurement of the vertical position of an adjustable crushing shell.

This object is achieved by a cone crusher comprising an outer crushing shell and an inner crushing shell forming between them a crushing gap, the outer crushing shell being supported on an upper frame member in vertically adjustable engagement with a lower frame member, said vertically adjustable engagement being configured for adjusting the vertical position of the outer crushing shell relative to the lower frame member so as to permit adjustment of the width of the crushing gap, and a sensor arrangement provided with a sensor element mounted to one of the lower frame member and the upper frame member for measuring the vertical position of the outer crushing shell, wherein the crusher further comprises a target means arranged to be detectable by said sensor element, wherein one of the target means and the sensor element being arranged to follow vertical movement of the upper frame member and to move in relation to the other one of the target means and the sensor element, said sensor element comprising a vertical sensing array which extends in a vertical direction along at least a portion of a range within which the target means may be moved upon adjusting the vertical position of the upper frame member, and the target means being detectable at different vertical positions along the vertical sensing array.

This crusher has the advantage that the vertical position of the outer crushing shell can be measured with high level of accuracy. This is possible since the distance between the sensor element and the target means may be short and well-defined along the entire range of movement of such a target. Hence, the sensor is arranged to look, e.g., for changes in an electro-magnetic sensing field, in a horizontal direction. By looking in a horizontal direction a constant distance between the target means and the sensor may be maintained.

The target means may comprise a circumferential flange in order to even further improve the level of accuracy in measuring the vertical position of the outer crushing shell and/or to enable reducing the risk of damage to sensitive component(s) of the sensor arrangement.

According to an embodiment the circumferential flange is externally arranged on the upper frame member and the sensor arrangement is mounted to the lower frame member to ensure measuring the vertical position in a robust and reliable manner.

Preferably the sensor element comprises a sensor that is able to detect the presence of a target means without any physical contact therewith. The sensor element and a target of the target means are preferably arranged with a clearance therebetween to prevent damage to the sensor element.

According to one embodiment the sensor element comprises an inductive sensor. The vertical sensing array may then comprise coils arranged in a coil array. An advantage of an inductive sensor is that such a sensor has a good ability to accurately measure the position of the target means in high shock and high vibration environments. This embodiment has the advantage that a very robust and reliable measuring of the vertical position is achieved.

The distance between the outer surface of said sensing array and a target of said target means may be substantially constant.

According to an embodiment the target means comprises a sliding member arranged to abut at least a portion of said flange. This embodiment has the advantage that the movement of a target of the target means, which target may be the sliding member itself or an element mounted on the sliding member, may be limited to vertical movements, which may improve the robustness and reliability of the sensor arrangement since possible damage to sensitive component(s) of the sensor arrangement is prevented.

The target means preferably comprises a resilient member arranged to press the sliding member against at least a portion of said flange in order to ensure that the sliding member follows vertical movements of the flange, and thereby movements of the upper frame member.

The resilient member is preferably a spring, such as a compression spring.

The sliding member is preferably provided with a target formed from a magnetic metallic material, such as steel, which is detectable by the sensor element. An advantage of this embodiment is that the sliding member itself does not need to be detectable by the sensor element and may thus be formed from a material that is chosen mainly with respect to suitable properties for sliding against the flange.

According to an embodiment the target of the target means has a vertical height which is in the range of 2 to 25 mm.

BRIEF DESCRIPTION OF THE DRAWINGS

The invention will hereafter be described in more detail and with reference to the appended drawings.

DETAILED DESCRIPTION OF PREFERRED EMBODIMENTS

Figure 1:
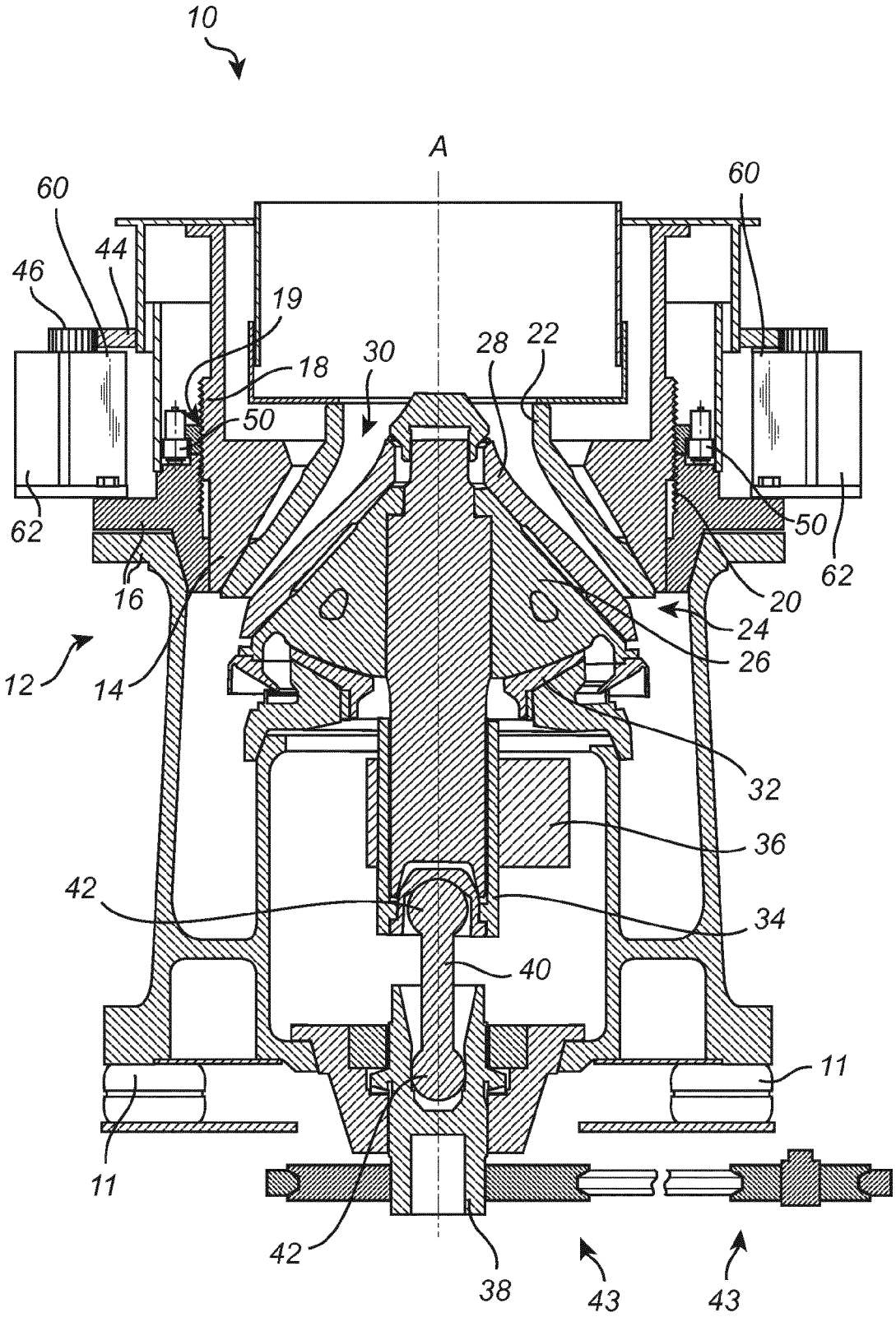
FIG. 1 is a cross-section and illustrates, schematically, a cone crusher according to one embodiment.
Figure 2:
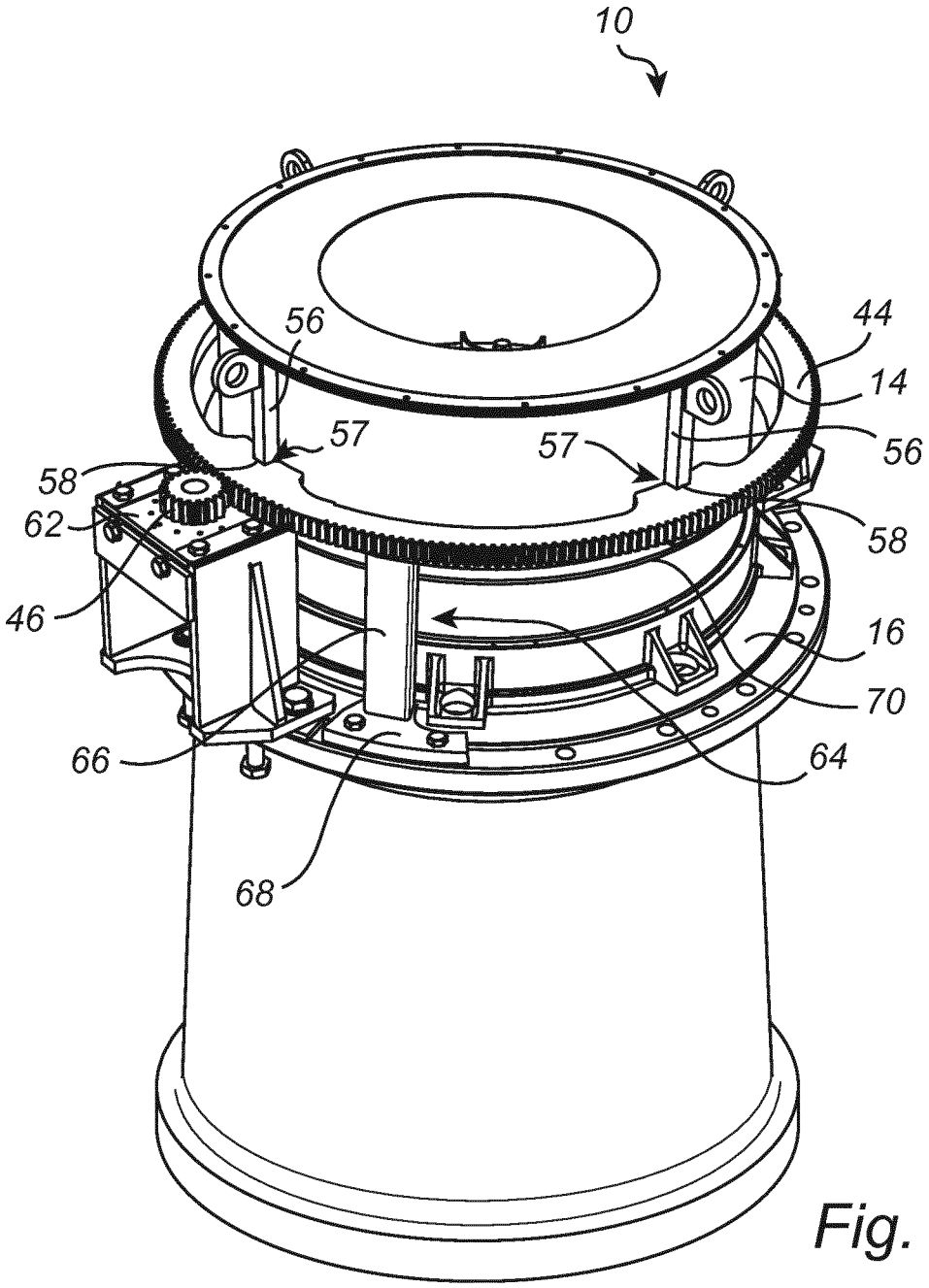
FIG. 2 is a schematic perspective view of the cone crusher of FIG. 1 and illustrates a sensor arrangement according to a first embodiment.

FIGS. 1 and 2 illustrate a cone crusher 10 which is of the inertia cone crusher type. The cone crusher 10 comprises a crusher frame 12 in which the various parts of the crusher 10 are mounted. The frame 12 is suspended on cushions 11 to dampen vibrations occurring during the crushing action.

The crusher frame 12 comprises an upper frame member 14, which has the shape of a bowl, and a lower frame member 16. The upper frame member 14 is provided with an outer thread 18, which co-operates with an inner thread 20 of the lower frame member 16 in such a manner that the outer and inner threads 18, 20 together form a vertically adjustable engagement of the upper frame member 14 to the lower frame member 16 in the form of a threaded engagement 19.

The upper frame member 14 supports, on the inside thereof, an outer crushing shell 22. The lower frame member 16 supports an inner crushing shell arrangement 24. The inner crushing shell arrangement 24 comprises a crushing head 26, which has the shape of a cone and which supports an inner crushing shell 28. The outer and inner crushing shells 22, 28 form between them a crushing gap 30, to which material that is to be crushed is supplied.

The crushing head 26 rests on a spherical bearing 32, which is supported by the lower frame member 16. Hence, the crushing head 26 with the inner crushing shell 28 supported thereon, is supported by the lower frame member 16. The crushing head 26 is rotatably connected to an unbalance bushing 34, which has the shape of a cylindrical sleeve. An unbalance weight 36 is mounted on one side of the unbalance bushing 34. At its lower end the unbalance bushing 34 is connected to a drive shaft 38 via a transmission shaft 40. Universal joints 42 of the transmission shaft 40 allow the lower end of the unbalance bushing 34 to be displaced from a vertical axis A during operation of the crusher 10.

When the crusher 10 is in operation, the drive shaft 38 is rotated by a motor in a non-illustrated manner, e.g. via a belt-and-pulley transmission 43. The rotation of the drive shaft 38 causes the unbalance bushing 34 to rotate, and as an effect of that rotation the unbalance bushing 34 swings outwards in response to the centrifugal force to which the unbalance weight 36 is exposed. The combined rotation and swinging of the unbalance bushing 34 makes the crushing head 26 gyrate about a vertical axis, such that material is crushed in the crushing gap 30 formed between the outer and inner crushing shells 22, 28.

The width of the crushing gap 30 can be adjusted by turning the upper frame member 14, by means of the threads 18, 20, such that the vertical distance between the shells 22, 28 is adjusted. To this end, the upper frame member 14 is provided with a circumferential gear ring 44. The gear ring 44 is in mesh with a pinion 46, which is arranged to be rotated by a crushing gap adjustment motor (not shown) mounted within a motor bracket 62 fitted to the lower frame member 16. By operating the crushing gap adjustment motor, the pinion 46 turns the gear ring 44, and thereby also the upper frame member 14, such that the upper frame member 14 is vertically translated by the threaded engagement 19. Thereby, also the outer crushing shell 22 is vertically translated, such that the width of the crushing gap 30 is adjusted.

As is best illustrated in FIG. 2, the gear ring 44 is connected to the upper frame member 14 via keyed sliding engagements 57, which allow the gear ring 44 to remain in engagement with the pinion 46 while the upper frame member 14 is vertically translated. The keyed sliding engagements 57 are formed by vertical bars 56, attached to the upper frame member 14, which are keyed with mating notches 58 of the inner periphery of the gear ring 44. Thereby, the gear ring 44 is rotationally locked to the upper frame member 14, and may slide vertically along the bars 56. The gear ring 44 rests and slides, when being turned, upon an upper portion of the motor support bracket 62.

Continuing with the description of FIG. 2, the cone crusher 10 comprises a sensor arrangement 64 for measuring the vertical position of the upper frame member 14 and of the outer crushing shell 22 supported thereby. The sensor arrangement 64 comprises a sensor housing 66 which is mounted on a sensor housing bracket 68 fitted to the lower frame member 16.

The upper frame member 14 is provided with a circumferential flange 70, as will be described in more detail with reference to FIGS. 3*a* and 3*b*. The outwardly projecting flange 70 is fixedly mounted to the upper frame member 14 by bolts (not shown).

Figures 3A, 3B:
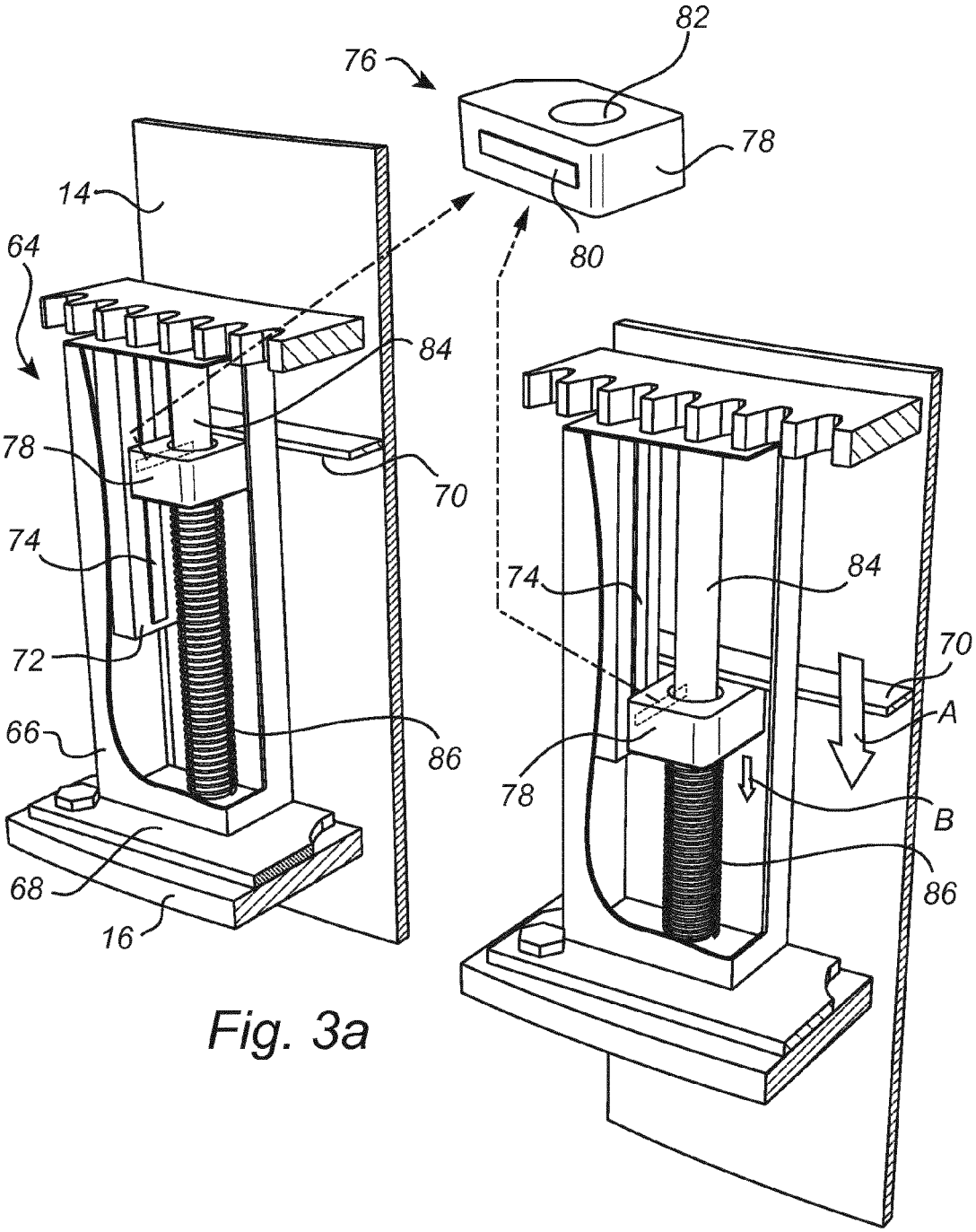
FIG. 3*a* is a magnified view of the sensor arrangement illustrated in FIG. 2, illustrated in a first position.
FIG. 3*b* is a magnified view of the sensor arrangement, illustrated in a second position.

FIGS. 3*a* and 3*b* illustrate in greater detail the sensor arrangement 64. The sensor arrangement 64 comprises a sensor element 72 mounted within the sensor housing 66 on a side wall thereof. The sensor element 72 comprises an elongate vertical sensing array 74 which extends in a vertical direction. The vertical sensing array 74 may typically have a vertical height which is in the range of 50 to 2000 mm. The vertical sensing array 74 may typically have a horizontal width which is in the range of 0.1 to 200 mm. In this embodiment the sensor element 72 comprises an inductive position sensor. Such an inductive position sensor generates an inductive field which shifts along a sensitive surface and detects a metallic target in the detection range of the inductive field. The inductive sensor comprises several coils arranged in a coil array. Hence, in this embodiment the vertical sensing array 74 comprises a coil array. The inductive sensor calculates the current position of the target and provides output either as a distance-proportional analog signal or as a definable switching position. The inductive sensing field extends along the vertical height of the vertical sensing array 74. The sensor element 72 is thus able to detect the vertical position along the vertical sensing array 74 of a metal target without any physical contact therewith. The sensor output is received by a control unit (not shown) connected to the sensor element 72.

The crusher 10 comprises a target means 76 arranged to follow vertical movement of the upper frame member 14. In this embodiment the target means 76 comprises a sliding member 78, a metallic target 80 attached to the sliding member 78, and the circumferential flange 70.

The sliding member 78 is provided with a hole 82 in which a guiding rod 84 is received. The guiding rod 84 is mounted within the sensor housing 66 to guide movement of the sliding member 78. The sliding member 78 is arranged around the guiding rod 84 and is thus free to move in a vertical direction under the guidance of the guiding rod 84. A compression spring 86 is arranged around the guiding rod 84 between the sliding member 78 and a bottom plate of the sensor housing 66 to exert a vertical pressing force on the sliding member 78. The sliding member 78 is pressed vertically upwards and against the flange 70 and thus abuts a lower portion of the outwardly projecting flange 70.

Vertical adjustment of the frame member 14 is achieved by rotating the gear ring 44 by means of pinion 46 and adjustment motor, as described hereinbefore with reference to FIG. 2. In one example, starting out from the situation illustrated in FIG. 3*a*, the upper frame member 14 is moved vertically downwards. Then the flange 70, which is rigidly attached to the upper frame member 14, is displaced downwards, as illustrated by arrow A in FIG. 3*b*. The sliding member 78, which abuts against a lower portion of the flange 70, then follows the vertical movement of the flange 70, as illustrated by arrow B in FIG. 3*b*. Hence, movement of the sliding member 78 is in this case caused by the vertical movement of the upper frame member 14 via the flange 70.

Upon adjustment of the upper frame member 14 in a direction upwards the flange 70 is displaced upwards. The sliding member 78, which is pressed against a lower portion of the flange 70 by the compression spring 86, then follows the vertical movement of the flange 70 due to the spring force of the spring 86. Movement of the sliding member 78 upwards to follow the movement of the flange 70 upon an adjustment of the upper member 14 upwards is thus caused by the force exerted on the sliding member 78 by the compression spring 86. Hence, the target means 76 comprising the sliding member 78 is arranged to follow vertical movement downwards as well as upwards of the upper frame member 14.

In order to generate a sensor output the target means 76 is detectable by the inductive sensor of the sensor element 72 along the vertical sensing array 74. To this end, the target means 76 comprises a metallic target 80, which is attached to the sliding member 78 in such a manner that it moves with the sliding member 78. The vertical sensing array 74 extends in a vertical direction along at least a portion of a vertical range within which the target 80 may be moved upon adjusting the vertical position of the upper frame member 14. The metallic target 80 may have a vertical height which is in the range of, for example, 2 to 25 mm. The vertical height of the metallic target 80 is adapted to the type of sensor element 72 that is utilized. In accordance with one example, the vertical height of the metallic target 80 may be 13 mm. The vertical sensing array 74 of the sensor element 72 may detect the vertical position of the target 80 with a high accuracy. In accordance with one embodiment, the sliding member 78 is made from an isolating material, such as a plastic material, in order not to interfere with the desired electrical interference between the target 80 and the vertical sensing array 74 of the sensor element 72.

The guiding rod 84 is arranged such that a constant clearance of typically about 0 to 20 mm, for example a clearance of 5 mm, is formed between the metallic target 80 and the outer surface of the sensing array 74. Hence, the horizontal distance between the target 80 and the sensing array 74 is substantially constant, regardless of the actual vertical position of the upper frame member 14, which provides for measuring the position of the upper frame member 14 with a high level of accuracy.

During operation of the sensor arrangement 64, the sensor element 72 emits an alternating electro-magnetic sensing field along the sensing array 74. When the metallic target 80 enters the sensing field eddy currents are induced in the target 80 which reduces the signal amplitude of the sensor element 72 and triggers a change of state at the sensor element 72 output received by the control unit. In this embodiment an inductive sensor called PMI-F110 commercially available from Pepperl+Fuchs GmbH was used.

Figure 4A:
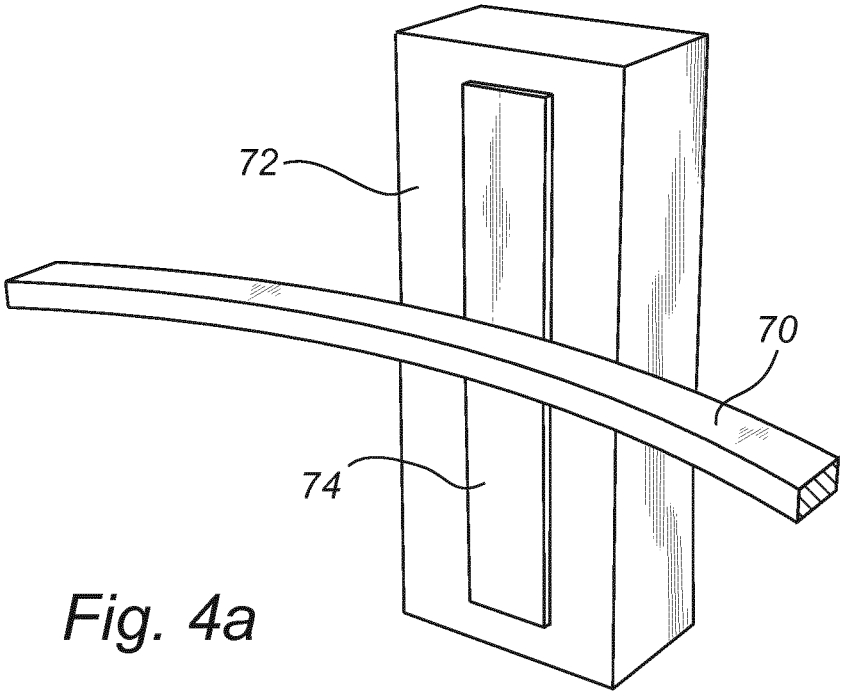
FIG. 4*a* is a schematic, partly sectional, perspective view and illustrates a sensor arrangement according to a second embodiment.
Figure 4B:
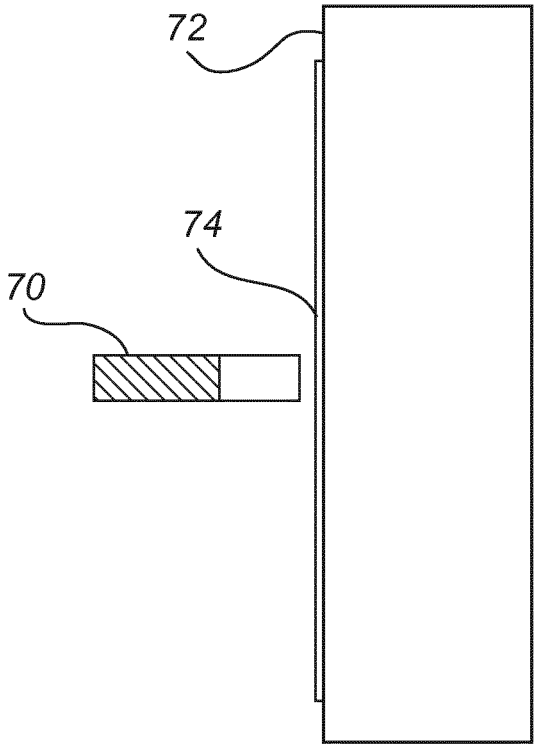
FIG. 4*b* is a schematic, partly sectional, side view and illustrates the sensor arrangement of FIG. 4*a*.

Hereinafter a crusher according to a second embodiment will be described with reference to FIGS. 4*a* and 4*b*. Many features disclosed in the first embodiment are also present in the second embodiment with similar reference numerals identifying similar or same features. Having mentioned this, the description will focus on explaining the differing features of the second embodiment.

In the second embodiment the target of the target means is formed by the circumferential flange 70 itself. The sensor arrangement comprises an inductive sensor element 72 provided with a vertical sensing array 74 which extends in vertical direction along at least a portion of a vertical range within which the target means, i.e. the flange 70, may be moved upon adjusting the vertical position of the upper frame member 14. The sensor element 72 is arranged such that the sensing array 74 faces a front edge of the flange 70. The flange 70 is thus detectable at different vertical positions along the vertical sensing array 74. The sensor element 72 is arranged such that a clearance is formed between the front edge of the flange 70 and the sensing array 74, as best illustrated in FIG. 4*b*. In this embodiment a sliding member as disclosed in the first embodiment is not needed since the flange 70 itself is detectable by the sensing array 74.

The invention has mainly been described above with reference to a few embodiments. However, as is readily appreciated by a person skilled in the art, other embodiments than the ones disclosed above are equally possible within the scope of the invention, as defined by the appended patent claims.

For example, the invention is not limited to any particular type of cone crusher; on the contrary, it is suited for many different types of cone crushers known to those skilled in the art, such as the type of crusher having the top of a head shaft journalled in a spider assembly, as well as the type of crusher that is described in U.S. Pat. No. 1,894,601, occasionally called Symons type, and the inertia type of cone crushers disclosed herein, having an unbalance weight for obtaining a gyratory motion of the crushing head.

The sensor element may comprise another type of sensor than the one described hereinbefore. For instance, the sensor element may comprise a capacitive or photoelectric sensor. In case the sensor element comprises a photoelectric sensor the target means preferably comprises a plastic target.

Hereinbefore it has been described that the sensor element 72 is attached to the lower frame member 16 and the target means is arranged to follow the vertical movement of the upper frame member 14. In an alternative embodiment a sensor element may instead be arranged to follow the vertical movement of the upper frame member 14, e.g. by way of abutment against the flange 70. A stationary target, e.g. in the form of a circumferential rim, may then be fixedly arranged to the lower frame member 16.

Instead of a compression spring 86 as disclosed in the first embodiment another arrangement may be used to press the sliding member 78 against at least a portion of the flange 70. For instance, a tension spring may be used for this purpose. Then the sliding member 78 is arranged to abut at least an upper portion of the flange.

Hereinbefore it has been described that the circumferential flange 70 is fixedly secured to the upper frame member 14. It is realised that a circumferential flange may, as alternative, be integrally formed with the upper frame member 14.

Further objects and features of the present invention will be apparent from the following detailed description and claims.

The invention claimed is:

1. A cone crusher comprising:

an outer crushing shell and an inner crushing shell forming between them a crushing gap, the outer crushing shell being supported on an upper frame member in vertically adjustable engagement with a lower frame member, said vertically adjustable engagement being configured for adjusting the vertical position of the outer crushing shell relative to the lower frame member so as to permit adjustment of a width of the crushing gap;

a sensor arrangement provided with a sensor element, the sensor arrangement being mounted to the lower frame member for measuring the vertical position of the outer crushing shell; and a target means arranged to be detectable by said sensor element, the target means being arranged to move vertically with the upper frame member and to move in relation to the sensor element, said sensor element including a vertical sensing array which extends in a vertical direction along at least a portion of a range within which the target means may be moved upon adjusting the vertical position of the upper frame member, and the target means being detectable at different vertical positions along the vertical sensing array.

2. A cone crusher according to claim 1, wherein the target means is a circumferential flange.

3. A cone crusher according to claim 2, wherein said circumferential flange is externally arranged on the upper frame member and said sensor arrangement is mounted to the lower frame member.

4. A cone crusher according to claim 1, wherein the target means includes a target and the sensing array and the target of the target means are arranged with a clearance therebetween.

5. A cone crusher according claim 1, wherein the sensor element includes an inductive sensor.

6. A cone crusher according claim 1, wherein a distance between an outer surface of said sensing array and a target of said target means is constant.

7. A cone crusher according to claim 2, wherein the target means includes a sliding member arranged to abut at least a portion of said flange.

8. A cone crusher according to claim 7, wherein the target means includes a resilient member arranged to press the sliding member against at least a portion of said flange.

9. A cone crusher according to claim 8, wherein said resilient member is a compression spring.

10. A cone crusher according to claim 7, wherein said sliding member is provided with a target which is detectable by the sensor element.

11. A cone crusher according to claim 1, wherein said target means includes a target formed from a magnetic metallic material.

12. A cone crusher according to claim 11, wherein the target has a vertical height which is in the range of 2 to 25 mm.

13. A cone crusher according to claim 11, wherein the magnetic metallic material is steel.

* * * * *